US009353953B1

(12) United States Patent
Frost

(10) Patent No.: US 9,353,953 B1
(45) Date of Patent: May 31, 2016

(54) HORIZONTAL VENTURI BURNER CONSTRUCTION

(71) Applicant: Timothy Frost, Chattanooga, TN (US)

(72) Inventor: Timothy Frost, Chattanooga, TN (US)

(73) Assignee: Burner Systems International, Inc., Chattanooga, TN (US)

( * ) Notice: Subject to any disclaimer, the term of this patent is extended or adjusted under 35 U.S.C. 154(b) by 443 days.

(21) Appl. No.: 14/025,205

(22) Filed: Sep. 12, 2013

Related U.S. Application Data

(60) Provisional application No. 61/700,439, filed on Sep. 13, 2012.

(51) Int. Cl.
*F24C 3/12* (2006.01)
*F24C 3/08* (2006.01)

(52) U.S. Cl.
CPC ..... *F24C 3/085* (2013.01)

(58) Field of Classification Search
CPC ..... F24C 3/106
USPC ..... 431/354, 191; 126/39 R, 39 E
See application file for complete search history.

(56) References Cited

U.S. PATENT DOCUMENTS 2,574,153 A * 11/1951 Meiners ..... F23D 14/065 239/288.5
2,918,119 A * 12/1959 Alger ..... F24C 3/106 126/39 R
3,834,416 A * 9/1974 Parkison ..... F16K 3/08 137/454.2
3,982,523 A * 9/1976 Love ..... A21B 3/00 126/19 R
5,833,449 A * 11/1998 Knight ..... F23D 14/04 126/110 R
2002/0132198 A1* 9/2002 O'Donnell ..... F23D 14/105 431/125
2004/0061332 A1* 4/2004 Takayanagi ..... F16L 37/0847 285/319

* cited by examiner

*Primary Examiner* — Avinash Savani
(74) *Attorney, Agent, or Firm* — Stephen J. Stark; Miller & Martin PLLC

(57) ABSTRACT

A horizontal venturi burner has at least one burner ring, if not several, supplied by respective ports which supply air/fuel mixture thereto. The ports are directed at orifice holders which are received in receivers preferably formed in cast top and bottom pots. The receivers may have openings on either side which allow single direction installation of the holders and preferably prevent rotation by having adjacent and cooperating flats/faces therein, as well as openings which properly position the holders in a desired axial arrangement.

20 Claims, 2 Drawing Sheets

HORIZONTAL VENTURI BURNER CONSTRUCTION

CLAIM OF PRIORITY

This application claims the benefit of U.S. Provisional Patent Application No. 61/700,439 filed Sep. 13, 2012, which is incorporated in its entirety by reference herein.

FIELD OF THE INVENTION

The present invention relates to a horizontal venturi burner construction, and more preferably one with improved supply connections.

BACKGROUND OF THE INVENTION

BSI and other suppliers produce burners with a construction that places the orifice in a vertical relationship to the burner venturi. A vertical orientation is often the most cost effective solution. However, in this style construction the amount of gas and air mixture that can sufficiently be introduced into the burner is sometimes limited due to the limited vertical space available in an appliance. In these cases, it is often a better solution to utilize a horizontal venturi construction since it is common to have more horizontal space available in the appliance allowing for a longer venturi. This longer venturi can allow for better mixing of the as and air and sometimes offer improved burner performance for at least some applications.

There have been many examples of horizontal venturi construction over the years. One difficulty in achieving these designs is the attachment of the orifice to the burner venturi. In previous designs, the end of the venturi that receives the orifice was machined or some complicated system of machined components and brackets were used. Accordingly, an improved horizontal venturi construction is believed to be desirable.

SUMMARY OF THE INVENTION

It is an object of many embodiments of the present invention to provide an improved burner construction.

It is another object of many embodiments of this invention to provide a unique and simple solution for attaching the orifice to an inlet of a horizontal venturi burner.

Accordingly, in accordance with a presently preferred embodiment of the present invention, a horizontal venturi construction has an orifice holder which is preferably machined with opposing flats, such as hexagonal flats, extending circumferentially around a middle portion of the orifice holder. The upper and lower flats are preferably retained within recessed areas of burner venturi pot top and bottom sections which capture and hold the orifice holder therebetween. The flats cooperate with cooperating sections of the venturi pot top and bottom sections so the orifice holder is entrapped within the sections preferably to prevent rotation, align the orifice holder with a centerline of the venturi gas/fuel mixture for at least some embodiments and/or fixedly locate the orifice holder at a desired spacing from the fuel/air inlet. Accordingly, a desired placement of the orifice holders can be achieved so that the inlet gas is directed as designed. Furthermore, no machining of the venturi pot sections needs to take place for at least some embodiments as has occurred with prior art horizontal venturis in the past.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENT

Figure 1:
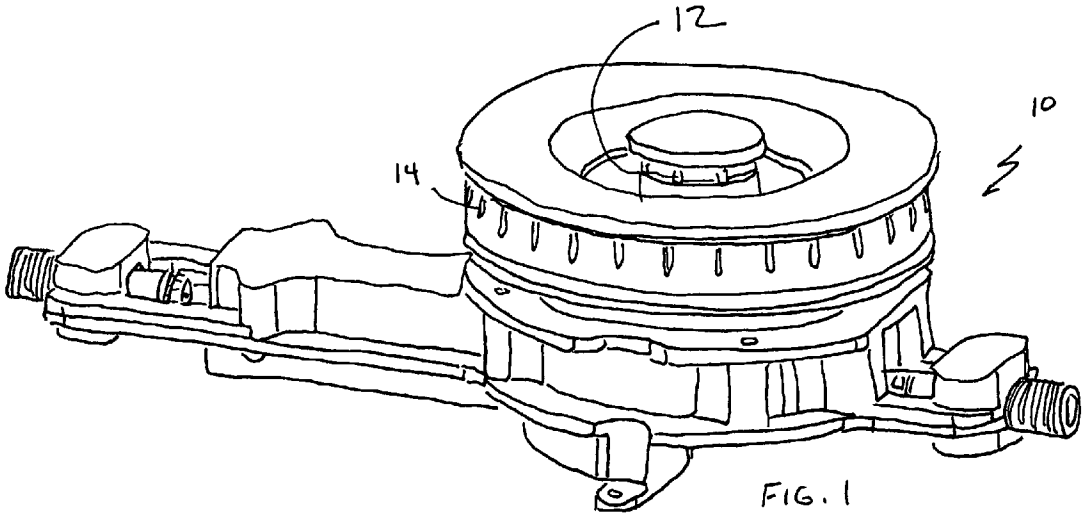
FIG. 1 is a top perspective view of the presently preferred embodiment of the present invention.
Figure 2:
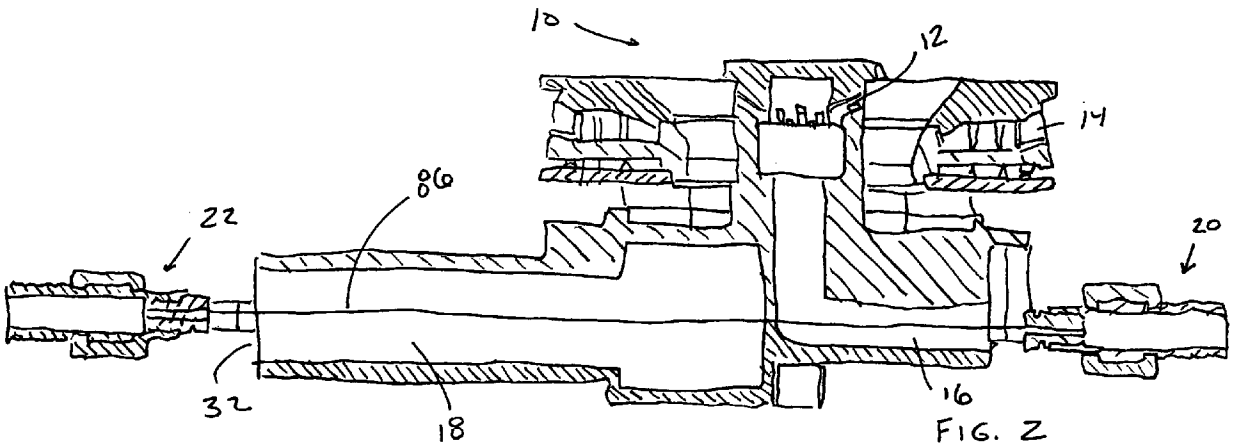
FIG. 2 is a cross sectional view taken along the lines A-A of FIG. 1.

FIG. 1 shows a perspective view of a burner 10. This embodiment is a dual ring burner having first and second burner rings 12,14. Other embodiments of burner 10 of the present invention can be provided with a single burner ring 12 or 14 as would be understood by those of ordinary skill in the art. Furthermore, still other embodiments may provide more than two rings 12,14 as would be understood by those of ordinary skill in the art. As can be seen in the cross section of FIG. 2, the first ring 12 is supplied by fuel/air mixture through first port 16 while the second ring 14 is fed by fuel/air mixture through second port 18.

In order to provide as to the fuel air mixture to ports 16,18, orifice holders 20,22 are illustrated as being employed. Obviously, a single main burner ring 12 or 14 would have only a single orifice holder 20 or 22. More rings 12,14 and/or others such as those with separate controls could have more orifice holders 20,22, etc.

The orifice holders 20,22 of the preferred embodiment are characterized in having a intermediate, central and/or middle section 24 which preferably has first and second opposing flats 26,28. In the preferred embodiment, first and second flats 26,28 are portions of a hexagonal section 24, but in other embodiments may have different cross sectional shapes. At lease one flat 26 or 28 will be desirable as will be explained below.

There is preferably a cylindrical shaped protrusion 30 of the orifice holders 22 extending towards the inlet 32 of the port 18 of the burner 10. The cylindrical protrusion 30 preferably has female or internal threads 34 which receive the external threads 36 of orifice insert 38 with an orifice 40 for at least some preferred embodiments. Alternatively, the cylindrical section 30 itself could provide an orifice 40 for at least some embodiments such as could be provided during the machining process. Orifice 40 is preferably a portion of orifice insert 38 which is commonly utilized throughout many of the applicant's products.

A second cylindrical section 42 is preferably provided opposite the central section 24 from the first cylindrical section 30 such as relative to the flat 26 or 28 and/or flats 26,28 of the middle section 24. The second section 42 may preferably provide a diameter smaller than the radius of the flats 26,28 and possibly others such as 44,46 illustrated. Furthermore, extending away from the middle section 24 relative to the second section 42 may preferably be an externally threaded section 48 which preferably receives a gas tube. Threaded section 48 is preferably provided with male threads but female threads could be provided internal to section 48 for at least some embodiments. Still other embodiments may connect to a gas tube with non-threaded connections.

Figure 3:
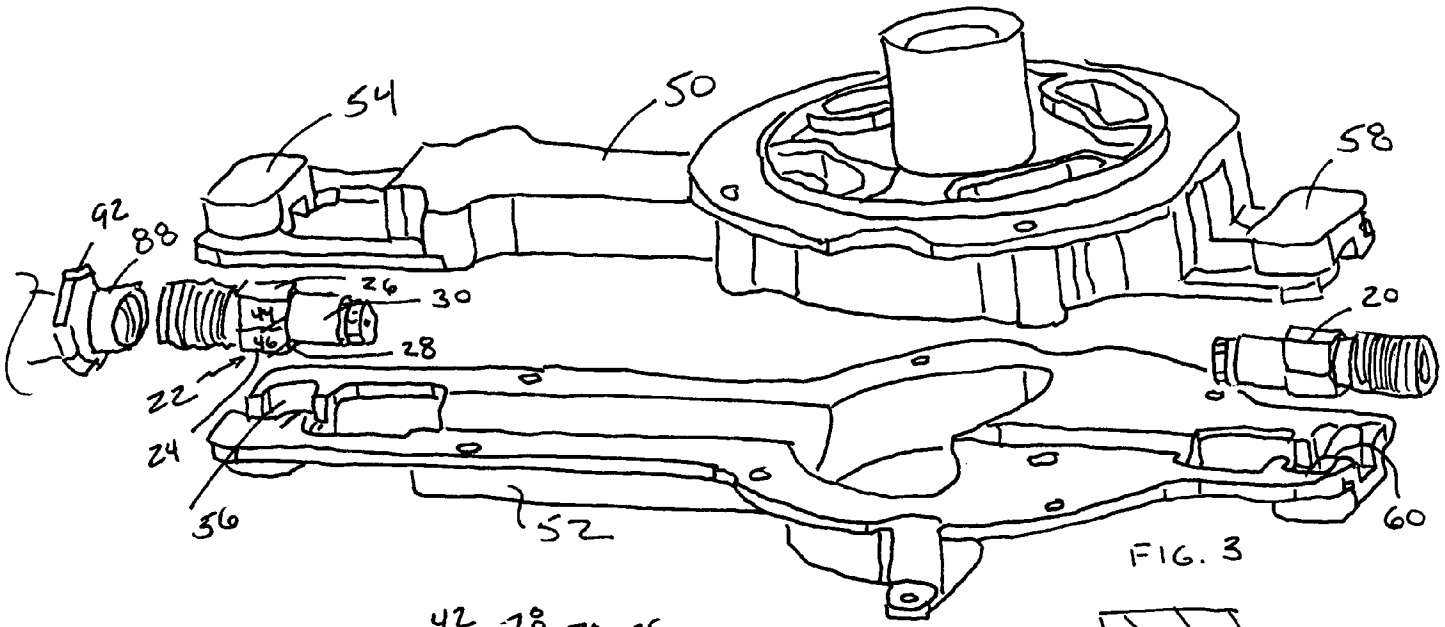
FIG. 3 is an exploded view of the constructions of FIG. 1 and FIG. 2.
Figure 4:
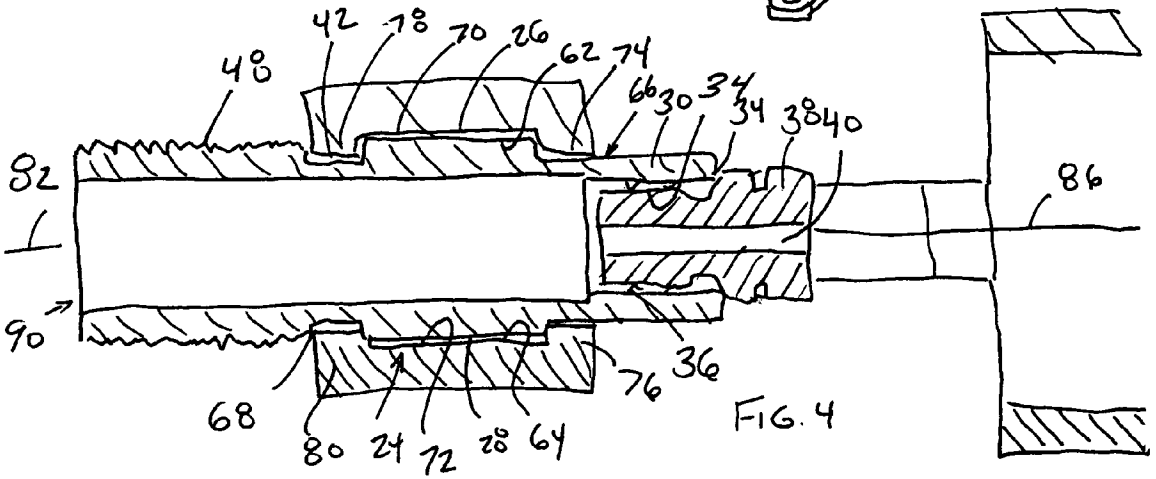
FIG. 4 is a detailed view of a portion of the invention shown in FIG. 2.

As can be seen from FIGS. 3 and 4, the flats 26 and/or 28 are preferably received within portions of venturi pot top section 50 and venturi pot bottom section 52. The two sections 50,52 are preferably made from aluminum using a die-casting process. However, other materials and/or processes could be used to provide the first and second receivers 54,56 which are similarly shown having similar constructions relative to the first orifice holder 20 as well as the second orifice holder 22.

The first and second recessed areas 54,56 receive at least one, if not both of the flats 26,28 of the middle section 24 of the orifice holder 22 as is shown in FIG. 4. In fact, internal face 62 is preferably adjacent first flat 26 to prevent rotation of the orifice holder 22 relative to receivers 54,56. Alternatively and/or additionally, internal face 64 is preferably adjacent to and cooperates with second flat 28 so that when installed to possibly further assist in preventing rotation. The middle section 24 preferably cannot rotate when the top and bottom sections 50,52 are connected together as would be understood by those of ordinary skill in the art since at least an flat 26,28 resists turning by at least one internal face 62 and/or 64. As can be seen in FIG. 4, the middle section 24 is preferably also entrapped within the recessed areas 54,56.

The recessed sections 54,56 preferably also has openings 66,68 through which the first cylindrical section 30 and the second cylindrical section 42 extend therethrough in an opposing fashion. In order to prevent errors in assembly by at least some operators, the first inlet 66 has a smaller diameter than the second inlet 42 possibly to prevent an assembler changing the direction of the orifice holder during assembly. Other embodiments may use similar diameters and/or different shaped sections 30,42 and/or inlets 66,68 so that they cooperate with the appropriate components. As shown in the drawings, the openings 66,68 also cooperate with the orifice holder sections 30,42 immediately before and after the middle section 24 of the orifice holder 22 preferably in an effort to prevent the orifice holder 22 from moving in a longitudinal direction along the axis of the venturi (i.e., closer or further away from the inlet 32 when installed).

One or more of the flats 26,28 and/or other portions of the middle section 24 preferably extend into wells 70,72 as retained by lips 74,76,78,80 respectively, so as to entrap the middle section 24 from longitudinal movement along axis 82 as shown in at least some preferred embodiments. The opening 66,64 also can be used to ensure that the center line 84 of the orifice holder 22 remains on the same center line 86 of the inlet 22 and/or the fuel/air mixture port 18.

By capturing the hexagonal section and/or middle section 24 of the orifice holder 22 between the two recessed areas 54,56 with openings 66,68 on both sides of the recessed areas 54,56, the end user can supply a gas supply tube 88 to the threaded portion 48 at end 90 by turning a nut 92 on the supply tube 88 or otherwise without a need to necessarily place a tool on the orifice holder 22 since the orifice holder 22 cannot rotate relative to the burner 10 due to the cooperating geometry of the recessed sections 54,56 in the hexagonal section 24 or other appropriate configuration with flats 26,28.

Furthermore, the longitudinal axial position of the orifice holder 22 can be provided in fixed alignment with the burner venturi shown as the fuel-air mixture port 18 due to cooperating geometry of the bottom and top of the pot sections 50,52 as well as recessed areas 54,56 and opening 66,68. The openings 66,68 cooperate with the cylindrical sections 38,42 which extend through the openings 66,68 thereby providing an entrapping construction in preferred embodiments to provide a very economical way of making top and bottom sections 50,52 while still providing the machined threaded portions of orifice holders 20,22 shown as threaded portions 48 which can be connected to a gas supply tube 88 in a particularly efficient and easy manner.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A horizontal venturi burner comprising:

a first burner ring supplied with a gas/air mixture from a first port, said first port having a first inlet;

a pot top and a pot bottom connected together forming a first receiver, the first receiver having a first planar face;

a first orifice holder having a middle section with a first planar flat and a first protrusion spaced from and directed toward the first inlet of the first port wherein gas directed through the first orifice holder mixes with air introduced through the first inlet of the first port, wherein the first flat is adjacent to the first planar face thereby preventing the first orifice holder from rotating relative to the first receiver, and the middle section is entrapped within the first receiver preventing axial movement along a gas flow axis when installed.

2. The horizontal venturi burner of claim 1 wherein the pot top and bottom form the first port.

3. The horizontal venturi burner of claim 1 wherein the first receiver has a second planar face opposite the first planar face.

4. A horizontal venturi burner comprising:

a first burner ring supplied with a gas/air mixture from a first port, said first port having a first inlet;

a pot top and a pot bottom connected together forming a first receiver, the first receiver having a first planar face;

a first orifice holder having a first planar flat and a first protrusion spaced from and directed toward the first inlet of the first port wherein gas directed through the first orifice holder mixes with air introduced through the first inlet of the first port, wherein the first flat is adjacent to the first planar face thereby preventing the first orifice holder from rotating relative to the first receiver when installed;

wherein the first receiver has a second planar face opposite the first planar face and the first orifice holder has a second planar flat opposite the first planar flat which is adjacent to the second planar face when installed.

5. The horizontal venturi burner of claim 4 wherein the first and second planar flats are portions of a hexagonal exterior surface portion of the first orifice holder.

6. The horizontal venturi burner of claim 4 further comprising a first lip adjacent to the first receiver preventing movement of the first orifice holder axially towards the first port.

7. The horizontal venturi burner of claim 6 wherein the first lip defines a first opening which cooperates with the first protrusion whereby the first protrusion extends through the first opening to be axially aligned with the first port.

8. A horizontal venturi burner comprising:

a first burner ring supplied with a gas/air mixture from a first port, said first port having a first inlet;

a pot top and a pot bottom connected together forming a first receiver, the first receiver having a first planar face;

a first orifice holder having a first planar flat and a first protrusion spaced from and directed toward the first inlet of the first port wherein gas directed through the first orifice holder mixes with air introduced through the first inlet of the first port, wherein the first flat is adjacent to the first planar face thereby preventing the first orifice holder from rotating relative to the first receiver when installed;

wherein a first lip defines a first opening which cooperates with the first protrusion whereby the first protrusion extends through the first opening to be axially aligned with the first port, and a second lip adjacent to the first receiver defining a second opening, said second opening cooperating with a second protrusion of the first orifice holder, said second protrusion opposite the first planar flat from the first protrusion, and said second protrusion received within the second opening.

9. The horizontal venturi burner of claim 8 wherein the first and second openings are of differing cross sectional shapes thereby permitting installation of the first orifice holder in a single orientation relative to the first receiver.

10. The horizontal venturi burner of claim 9 wherein the first and second protrusions are cylindrical and the first and second openings have different diameters.

11. The horizontal venturi burner of claim 1 further comprising a second port with a second inlet directing gas/air mixture to a second burner ring.

12. A horizontal venturi burner comprising:

a first burner ring supplied with a gas/air mixture from a first port, said first port having a first inlet;

a pot top and a pot bottom connected together forming a first receiver, the first receiver having a first planar face;

a first orifice holder having a first planar flat and a first protrusion spaced from and directed toward the first inlet of the first port wherein gas directed through the first orifice holder mixes with air introduced through the first inlet of the first port, wherein the first flat is adjacent to the first planar face thereby preventing the first orifice holder from rotating relative to the first receiver when installed, a second port with a second inlet directing gas/air mixture to a second burner ring; and a second receiver formed in the pot top and pot bottom, with the second receiver having a third planar face; and a second orifice holder having a third planar flat and a third protrusion spaced from and directed toward the second inlet of the second port wherein gas directed through the second orifice holder mixes with air introduced through the second inlet of the second port, wherein the third flat is adjacent to the third face thereby preventing the second orifice holder from rotating relative to the second receiver when installed.

13. The horizontal venturi burner of claim 12 wherein the pot top and bottom form the second port.

14. The horizontal venturi burner of claim 1 wherein the second receiver has a fourth planar face opposite the third planar face.

15. A horizontal venturi burner comprising:

a first burner ring supplied with a gas/air mixture from a first port, said first port having a first inlet;

a pot top and a pot bottom connected together forming a first receiver, the first receiver having a first planar face;

a first orifice holder having a first planar flat and a first protrusion spaced from and directed toward the first inlet of the first port wherein gas directed through the first orifice holder mixes with air introduced through the first inlet of the first port, wherein the first flat is adjacent to the first planar face thereby preventing the first orifice holder from rotating relative to the first receiver when installed;

wherein the second receiver has a fourth planar face opposite the third planar face and the second orifice holder has a fourth planar flat opposite the third planar flat which is adjacent to the fourth planar face when installed.

16. The horizontal venturi burner of claim 15 wherein the third and fourth planar flats are portions of a hexagonal exterior surface portion of the second orifice holder.

17. The horizontal venturi burner of claim 15 further comprising a third lip adjacent to the second receiver preventing movement of the second orifice holder axially towards the second port.

18. The horizontal venturi burner of claim 1 wherein the pot top and pot bottom are die cast metal.

19. A horizontal venturi burner comprising:

a first burner ring supplied with a gas/air mixture from a first port, said first port having a first inlet;

a pot top and a pot bottom connected together forming a first receiver, the first receiver having a first planar face;

a first orifice holder having a first planar flat and a first protrusion spaced from and directed toward the first inlet of the first port wherein gas directed through the first orifice holder mixes with air introduced through the first inlet of the first port, wherein the first flat is adjacent to the first planar face thereby preventing the first orifice holder from rotating relative to the first receiver when installed;

wherein the pot top and pot bottom are die cast metal and the pot top and pot bottom are aluminum.

20. The horizontal venturi burner of claim 1 wherein the first protrusion has internal threads which receive an orifice insert therein.

* * * * *